US009303512B2

(12) United States Patent
Iijima

(10) Patent No.: US 9,303,512 B2
(45) **Date of Patent: *Apr. 5, 2016**

(54) VANE PUMP

(71) Applicant: HITACHI AUTOMOTIVE SYSTEMS, LTD., Ibaraki (JP)

(72) Inventor: Masaaki Iijima, Maebashi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 536 days.

This patent is subject to a terminal disclaimer.

(21) Appl. No.: 13/660,196

(22) Filed: Oct. 25, 2012

(65) Prior Publication Data

US 2014/0119969 A1 May 1, 2014

(30) Foreign Application Priority Data

Mar. 22, 2012 (JP) ..... 2012-064765

(51) Int. Cl.

| | |
|---|---|
| ***F01C 21/00*** | (2006.01) |
| ***F04C 2/344*** | (2006.01) |
| ***F04C 14/22*** | (2006.01) |
| ***F01C 21/10*** | (2006.01) |

(52) U.S. Cl.

CPC ..... *F01C 21/106* (2013.01); *F04C 2/3442* (2013.01); *F04C 14/226* (2013.01)

(58) Field of Classification Search

USPC ..... 418/30, 28, 29, 82, 244, 260, 268, 269, 418/24–27; 417/364

See application file for complete search history.

(56) References Cited

U.S. PATENT DOCUMENTS

| | | | | |
|---|---|---|---|---|
| 4,242,068 | A | 12/1980 | Shaw | |
| 4,374,632 | A | 2/1983 | Wilcox | |
| 4,913,636 | A | 4/1990 | Niemiec | |
| 6,481,990 | B2 | 11/2002 | Wong et al. | |
| 7,070,399 | B2 | 7/2006 | Konishi et al. | |
| 7,247,008 | B2 | 7/2007 | Clements et al. | |
| 2001/0033797 | A1 * | 10/2001 | Gretzschel | F04C 14/226 417/220 |
| 2008/0308062 | A1 * | 12/2008 | Morita | F04C 14/226 123/196 R |
| 2010/0232989 | A1 * | 9/2010 | Watanabe et al. | 417/364 |
| 2011/0123379 | A1 * | 5/2011 | Saga | F04C 2/3442 418/26 |
| 2013/0251571 | A1 * | 9/2013 | Iijima | 418/28 |

FOREIGN PATENT DOCUMENTS

| | | |
|---|---|---|
| JP | 3631264 | 12/2004 |

* cited by examiner

*Primary Examiner* — Jorge Pereiro
*Assistant Examiner* — Paul Thiede
(74) *Attorney, Agent, or Firm* — Foley & Lardner LLP

(57) ABSTRACT

A vane pump includes a vane cam mounted in a recess of a rotor, and configured to move with eccentricity with respect to an axis of rotation of the rotor. A cam port is formed in a surface of a pump body facing the vane cam, and configured to hydraulically communicate with the recess of the rotor. The vane cam includes an outer peripheral surface configured to contact a proximal end of each of vanes, and configured to cause projection of the vanes along with rotation of the rotor. The vane cam hydraulically separates the proximal end portion of a first slot in a suction region from the proximal end portion of a second slot in a discharge region.

7 Claims, 6 Drawing Sheets

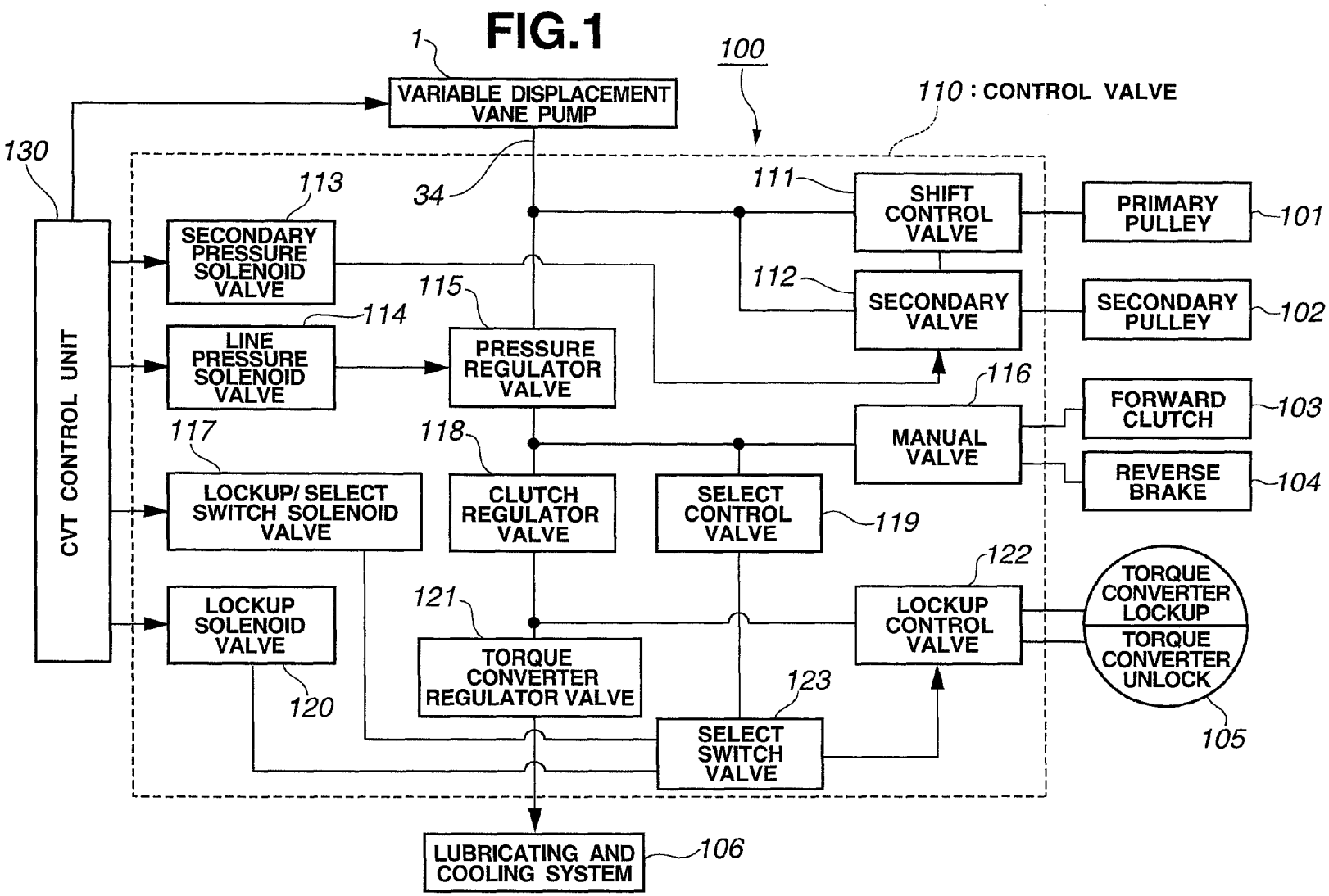
FIG.1
100
110 : CONTROL VALVE
1
VARIABLE DISPLACEMENT VANE PUMP
34
PRIMARY PULLEY
101
SECONDARY PULLEY
102
FORWARD CLUTCH
103
REVERSE BRAKE
104
TORQUE CONVERTER LOCKUP
TORQUE CONVERTER UNLOCK
105
SHIFT CONTROL VALVE
111
SECONDARY VALVE
112
116
MANUAL VALVE
119
LOCKUP CONTROL VALVE
122
SELECT CONTROL VALVE
123
SELECT SWITCH VALVE
106
LUBRICATING AND COOLING SYSTEM
PRESSURE REGULATOR VALVE
115
CLUTCH REGULATOR VALVE
118
TORQUE CONVERTER REGULATOR VALVE
121
SECONDARY PRESSURE SOLENOID VALVE
113
LINE PRESSURE SOLENOID VALVE
114
LOCKUP/ SELECT SWITCH SOLENOID VALVE
117
LOCKUP SOLENOID VALVE
120
CVT CONTROL UNIT
130

MAXIMALLY ECCENTRIC POSITION

MINIMALLY ECCENTRIC POSITION

FIG.9

| OPTION | PRESSURE ON PERIPHERY OF VANE CAM | FORCE ON VANE CAM | | EFFECT ON DRIVING TORQUE |
|---|---|---|---|---|
| | | IN RADIAL DIRECTION | IN AXIAL DIRECTION | |
| 1 | SUCTION PRESSURE IN SUCTION REGION AND DISCHARGE PRESSURE IN DISCHARGE REGION | 4 | 1 | 2 |
| 2 | SUCTION PRESSURE IN ENTIRE REGION | 3 | (4) | 2 |
| 3 | INTERMEDIATE PRESSURE IN ENTIRE REGION | 2 | 3 | 4 |
| 4 | DISCHARGE PRESSURE IN ENTIRE REGION | 1 | 4 | 4 |

VANE PUMP

BACKGROUND OF THE INVENTION

The present invention relates to vane pumps.

Japanese Patent 3631264 discloses a vane pump which includes a rotor provided with vanes extending radially of the rotor, wherein each vane is mounted in a slot, wherein each slot extends radially of the rotor. The vane pump includes first and second arc-shaped recesses formed to face an annular region in which a proximal end portion of each slot is located. The first arc-shaped recess corresponds to a suction region in which pumping chambers expand and suck working fluid along with rotation of the rotor. The first arc-shaped recess is supplied with a suction-side hydraulic pressure. The second arc-shaped recess corresponds to a discharge region in which the pumping chambers contract and discharge working fluid along with rotation of the rotor. The second arc-shaped recess is supplied with a discharge-side hydraulic pressure.

SUMMARY OF THE INVENTION

In such a vane pump as disclosed by Japanese Patent 3631264, each vane is subject to the hydraulic pressure supplied to the corresponding arc-shaped recess and the centrifugal force resulting from rotation of the rotor, and is thereby pressed to project from the corresponding slot of the rotor so that a distal end portion of the vane is brought into contact with an inner peripheral surface of a cam ring surrounding the rotor. When the rotor is rotating at low speed, it is possible that the centrifugal force is insufficient so that the vane does not fully project form the slot but remains out of contact with the inner peripheral surface of the cam ring. This condition may cause a large shock and noise by hard collision between the vane and the inner peripheral surface of the cam ring when the proximal end portion of the corresponding slot begins to overlap with the second arc-shaped recess and receive the higher hydraulic pressure of the discharge side from the second arc-shaped recess.

In view of the foregoing, it is preferable to provide a vane pump capable of operating without causing such problems.

According to one aspect of the present invention, a vane pump comprises: a pump body; a rotor housed in the pump body, and configured to rotate about an axis of rotation, wherein the rotor includes an outer periphery formed with a plurality of slots; a cam ring housed in the pump body, and arranged to surround the outer periphery of the rotor, and configured to move with eccentricity with respect to the axis of rotation of the rotor; and a plurality of vanes mounted in corresponding ones of the slots of the rotor, and configured to project from the corresponding slots, and separate an annular space between the rotor and the cam ring into a plurality of pumping chambers; wherein the pump body includes a first inner surface facing an axial end surface of the cam ring and a first axial end surface of the rotor, and defining axial ends of the pumping chambers; the first inner surface of the pump body includes a suction port, a suction-side back pressure port, a discharge port, and a discharge-side back pressure port; the suction port is located in a suction region in which each of the pumping chambers expands along with the rotation of the rotor; the discharge port is located in a discharge region in which each of the pumping chambers contracts along with the rotation of the rotor; the suction-side back pressure port is located to hydraulically communicate with a proximal end portion of a first one of the slots under condition that the vane corresponding to the first slot is in the suction region; the discharge-side back pressure port is located to hydraulically communicate with a proximal end portion of a second one of the slots under condition that the vane corresponding to the second slot is in the discharge region; the suction port and the suction-side back pressure port are commonly subject to a suction pressure; the discharge port and the discharge-side back pressure port are commonly subject to a discharge pressure; the rotor includes a second axial end surface opposite to the first axial end surface, wherein the second axial end surface includes a recess; the vane pump further comprises: a vane cam mounted in the recess of the rotor, and configured to move with eccentricity with respect to the axis of rotation of the rotor; and a cam port formed in a surface of the pump body facing the vane cam, and configured to hydraulically communicate with the recess of the rotor; the vane cam includes an outer peripheral surface configured to contact a proximal end of each of the vanes, and configured to cause the projection of the vanes along with the rotation of the rotor; and the vane cam hydraulically separates the proximal end portion of the first slot from the proximal end portion of the second slot. The vane pump may be configured so that the cam port is subject to the suction pressure. The vane pump may be configured so that: the vane cam includes a through hole extending axially of the vane cam, wherein the through hole allows a drive shaft to pass through, wherein the rotor is rotated by the drive shaft; the pump body rotatably supports the drive shaft on both axial sides of the rotor; and the through hole of the vane cam has an inner peripheral surface, wherein the inner peripheral surface is out of contact with the drive shaft under condition that the vane cam is maximally eccentric with respect to the axis of rotation of the rotor. The vane pump may be configured so that the inner peripheral surface of the through hole of the vane cam is configured in a manner that the vane cam seals the proximal end portions of the slots under condition that the vane cam is maximally eccentric with respect to the axis of rotation of the rotor. The vane pump may be configured so that the pump body includes a front body and a rear body, wherein the recess of the rotor in which the vane cam is mounted faces the rear body. The vane pump may be configured so that the vane cam has a disc-shape. The vane pump may be configured so that the outer peripheral surface of the vane cam has a diameter smaller substantially by twice a length of each vane than an inner peripheral surface of the cam ring.

BRIEF DESCRIPTION OF THE DRAWINGS

FIG. 1 is a block diagram showing configuration of a continuously variable transmission provided with a vane pump according to a first embodiment of the present invention.

FIG. 9 is a table which summarizes effects produced by the first to fourth options of FIGS. 5A to 8B in view of pressure around the vane cam, forces acting on the vane cam, and driving torque affected by friction.

DETAILED DESCRIPTION OF THE INVENTION

Configuration of Vane Pump

Figure 2:
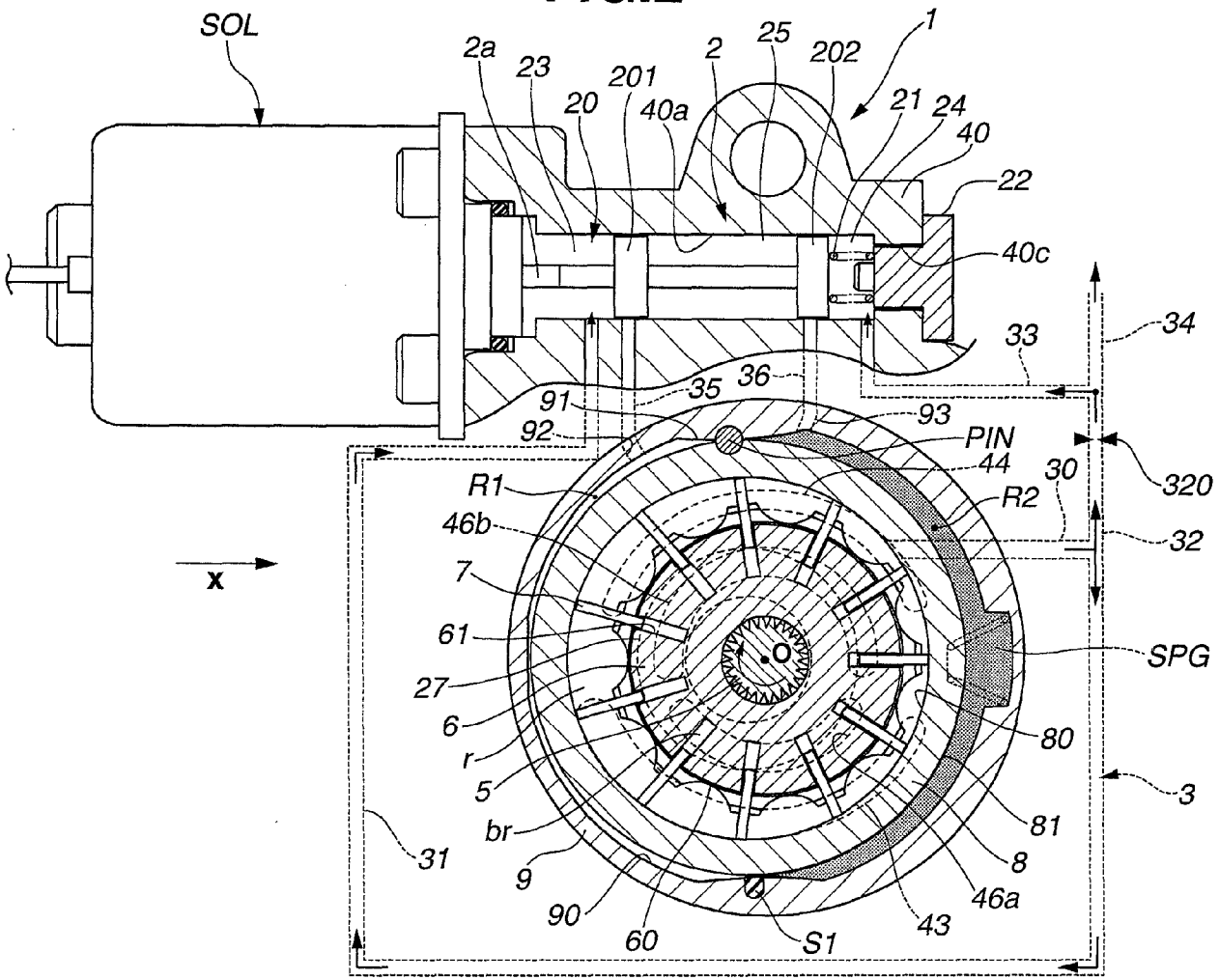
FIG. 2 is a cross-sectional view of the vane pump according to the first embodiment as viewed along an axis of rotation of a rotor of the vane pump.

A vane pump 1 according to a first embodiment of the present invention is used as a source of hydraulic pressure for a hydraulic system of a motor vehicle that is a belt-type continuously variable transmission (CVT) 100 in this embodiment. FIG. 1 shows an example of configuration of CVT 100. CVT 100 includes a control valve 110 composed of a set of various valves which are controlled by a CVT control unit 130. The controlled valves include a shift control valve 111, a secondary valve 112, a secondary pressure solenoid valve 113, a line pressure solenoid valve 114, a pressure regulator valve 115, a manual valve 116, a lockup/select switch solenoid valve 117, a clutch regulator valve 118, a select control valve 119, a lockup solenoid valve 120, a torque converter regulator valve 121, a lockup control valve 122, and a select switch valve 123. Vane pump 1 is configured to discharge working fluid which is supplied to various components of CVT 100. The components include a primary pulley 101, a secondary pulley 102, a forward clutch 103, a reverse brake 104, a torque converter 105, and a lubricating and cooling system 106.

Figure 3:
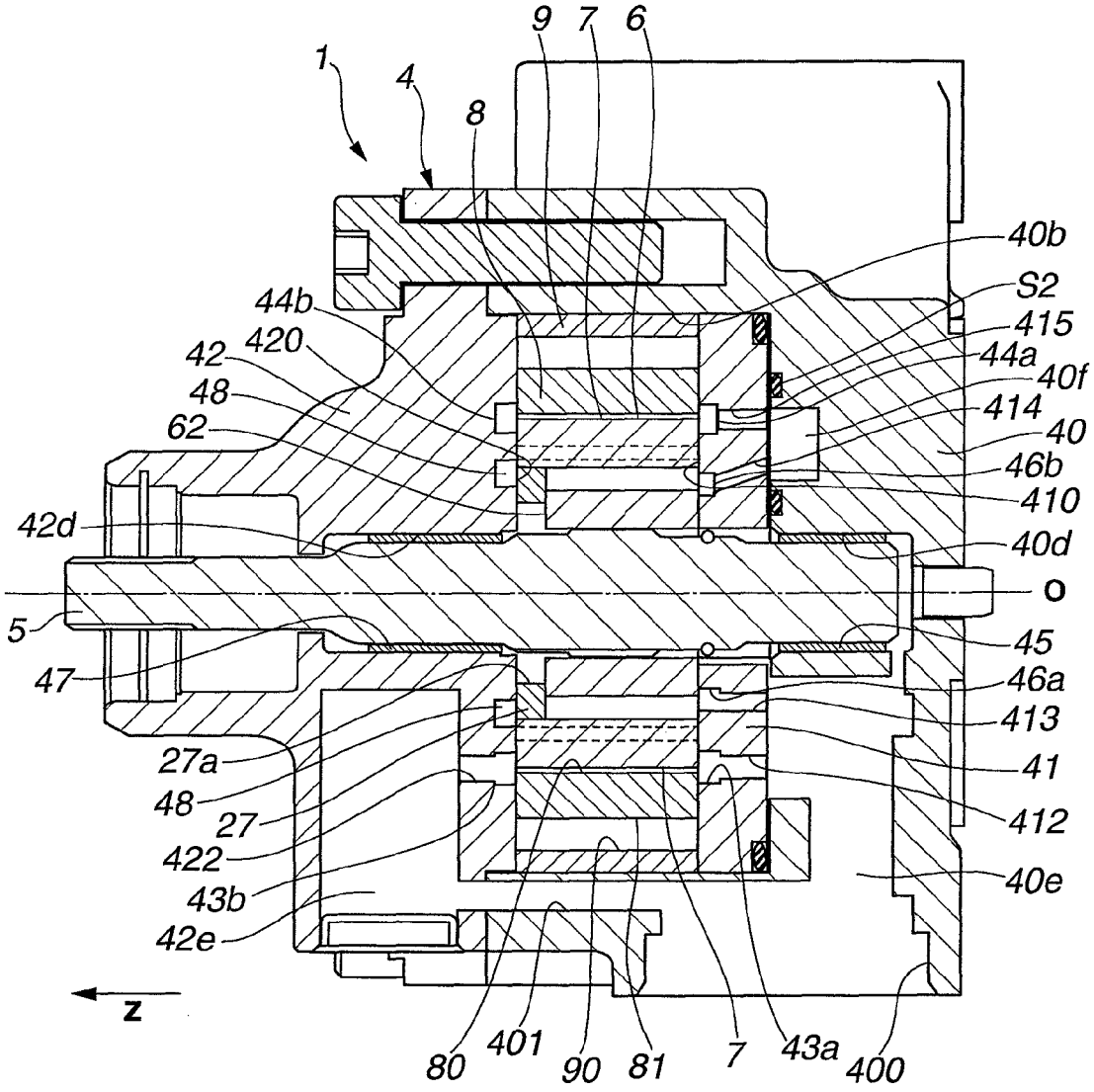
FIG. 3 is a cross-sectional view of the vane pump according to the first embodiment as viewed in a direction perpendicular to the axis of rotation of the rotor.

Vane pump 1 is driven by a crankshaft of an internal combustion engine of the motor vehicle, to suck and discharge working fluid such as oil. The working fluid is automatic transmission fluid (ATF) in this example. Vane pump 1 is of a variable displacement type capable of varying its pump displacement (i.e. quantity of working fluid discharged per one rotation). Vane pump 1 includes a pumping section for sucking and discharging working fluid, a control section for controlling the pump displacement, and a pump body 4 for housing the pumping section and the control section. FIGS. 2 and 3 show cross-sectional views of vane pump 1. FIG. 2 is a cross-sectional view of vane pump 1 as viewed along an axis of rotation O of a rotor 6 of vane pump 1, showing a cross-section of the pumping section except pump body 4 taken along a plane perpendicular to the axis of rotation O of rotor 6, and showing a cross-section of the control section taken along a plane including a longitudinal axis of a control valve 2. FIG. 3 is a cross-sectional view of vane pump 1 as viewed in a direction perpendicular to the axis of rotation O, showing a cross-section of the pumping section including the pump body 4 taken along a plane including the axis of rotation O. For ease of explanation, an x-axis is defined to extend in parallel to the longitudinal axis of control valve 2, wherein a direction where a valve element in the form of a spool 20 moves away from a solenoid SOL, i.e. a direction from the left to the right in FIG. 2, is defined as an x-axis positive direction. In addition, a z-axis is defined to extend in parallel to the axis of rotation O of rotor 6, wherein a direction from the drawing sheet of FIG. 2 to a reader is defined as a z-axis positive direction.

Configuration of Pumping Section

The pumping section generally includes a drive shaft 5, a rotor 6, a plurality of vanes 7, a cam ring 8, and an adapter ring 9. Drive shaft 5 is driven by the crankshaft to rotate about the axis of rotation O. Rotor 6 is rotated by drive shaft 5 to rotate about an axis of rotation that is identical to the axis of rotation O of drive shaft 5 in this example. Rotor 6 includes an outer peripheral surface formed with a plurality of slots 61. Each vane 7 is mounted in a corresponding one of slots 61 and configured to move forward and rearward with respect to the axis of rotation O of rotor 6. Cam ring 8 is arranged to surround the outer peripheral surface of rotor 6. Adapter ring 9 is arranged to surround an outer peripheral surface of cam ring 8. Pump body 4 includes a rear body 40, a pressure plate 41, and a front body 42. Rear body 40 includes a housing recess 40*b* which houses the rotor 6, vanes 7, and cam ring 8 inside. Pressure plate 41 is mounted at a z-axis negative direction side bottom of housing recess 40*b* of rear body 40, and is arranged on a z-axis negative direction side of cam ring 8 and rotor 6, defining a plurality of pumping chambers r in cooperation with rotor 6, vanes 7 and cam ring 8. Front body 42 closes the opening of housing recess 40*b* of rear body 40, and is arranged on the z-axis positive direction side of cam ring 8 and rotor 6, defining the plurality of pumping chambers r in cooperation with rotor 6, vanes 7 and cam ring 8. Drive shaft 5 is rotatably and pivotally supported by pump body 4 that is thus composed of rear body 40, pressure plate 41, and front body 42. Drive shaft 5 includes a z-axis positive direction side portion which is coupled though a chain to the crankshaft of the internal combustion engine, so that drive shaft 5 rotates in synchronization with the crankshaft. Rotor 6 is coupled to an outer periphery of drive shaft 5 by serration coupling so that rotor 6 and drive shaft 5 rotate in the clockwise direction of FIG. 2 about the common axis of rotation O.

The housing recess 40*b* of rear body 40 extends in the z-axis direction, and has a cylindrical shape. In the housing recess 40*b*, the annular adapter ring 9 is mounted with its outer peripheral surface in contact with and fitted to the inner peripheral surface of housing recess 40*b*. Adapter ring 9 has a hollow cylindrical shape with a cylindrical housing hole 90 extending in the z-axis direction. The housing hole 90 of adapter ring 9 houses the annular cam ring 8 under condition that cam ring 8 is configured to move or swing with respect to the axis of rotation O of rotor 6. Adapter ring 9 includes an x-axis positive direction side portion to which one longitudinal end of an elastic member in the form of a coil spring SPG is connected, whereas the other longitudinal end of coil spring SPG is connected to an x-axis positive direction side portion of cam ring 8. Coil spring SPG is mounted in compressed state so that cam ring 8 is constantly biased in the x-axis negative direction with respect to adapter ring 9.

Between adapter ring 9 and cam ring 8 is provided a pin PIN for preventing relative rotation therebetween. Specifically, pin PIN is disposed in a space defined by a recess of an inner peripheral surface (rolling surface 91) of adapter ring 9 and a recess of an outer peripheral surface 81 of cam ring 8. Pin PIN is fixed to pump body 4 at its both longitudinal ends. Cam ring 8 is supported with respect to adapter ring 9 by rolling surface 91 where pin PIN is disposed, and configured to rotate or swing about the pin PIN. Adapter ring 9 also includes a second recess at a portion of the inner peripheral surface opposite to pin PIN with respect to axis of rotation O of rotor 6, wherein a seal S1 is mounted in the second recess of adapter ring 9.

When cam ring 8 is swinging with respect to adapter ring 9, the rolling surface 91 of the inner periphery of adapter ring 9 is in rolling contact with the outer peripheral surface 81 of cam ring 8, whereas seal S1 is in sliding contact with the outer peripheral surface 81 of cam ring 8. An eccentric distance δ is defined to represent a distance of the central axis of cam ring 8 from the axis of rotation O of rotor 6. When cam ring 8 is in a position of minimum eccentricity so that the central axis of cam ring 8 is identical to the axis of rotation O, the eccentric distance δ is equal to zero. On the other hand, when cam ring 8 is in a position of maximum eccentricity so that the outer peripheral surface 81 of cam ring 8 is in contact with the x-axis negative direction side of the inner peripheral surface of adapter ring 9 as shown in FIG. 2, the eccentric distance δ is equal to a specific maximum value.

Rotor 6 is mounted radially inside of the inner periphery of cam ring 8. Rotor 6 includes a plurality of slots 61 which extend radially. As viewed in the z-axis direction, each slot 61 extends straight from an outer peripheral surface 60 of rotor 6 toward the axis of rotation O by a predetermined distance in a radial direction of rotor 6. Each slot 61 extends over the entire thickness of rotor 6 in the z-axis direction. In this embodiment, rotor 6 is formed with eleven slots 61 which are arranged and evenly spaced in the circumferential direction of rotor 6. Each slot 61 has a proximal end portion closer to the axis of rotation O in which a back pressure chamber br is defined to extend in the z-axis direction. Each back pressure chamber br has the same cross-section as slot 61.

Each vane 7 is a substantially rectangular plate, and is mounted in a corresponding different one of slots 61, and is configured to move forward and rearward in the slot 61. The number of slots 61 and the number of vanes 7 are not limited to 11 but may be more or less. The distal end portion of vane 7 (farther from the axis of rotation O) has a moderately curved surface fitted on the shape of inner peripheral surface 80 of cam ring 8.

Rotor 6 includes a z-axis positive direction side portion formed with a circular recess 62 extending in the axial direction of rotor 6. The inside diameter of circular recess 62 is set so that the inner periphery of circular recess 62 has a circular shape identical to a circular shape formed by connecting the proximal end of each vane 7 when vane 7 projects maximally from the corresponding slot 61.

Circular recess 62 of rotor 6 retains and houses a vane cam 27 which is ring-shaped to have a through hole 27*a*. The outside diameter of vane cam 27 is set equal to a value produced by subtracting twice the length of vane 7 from the outside diameter of inner peripheral surface 80 of cam ring 8. Namely, vane cam 27 is configured to move together with cam ring 8 with eccentricity from the axis of rotation O of rotor 6, and has an outer peripheral surface that is constantly in contact with the proximal end portions of all of vanes 7. The thickness of vane cam 27 in the axial direction of rotor 6 is substantially equal to the depth of circular recess 62 of rotor 6. Vane cam 27 allows drive shaft 5 to pass through the through hole 27*a*. Specifically, the inside diameter of through hole 27*a* of vane cam 27 is set in a manner that even when vane cam 27 is maximally eccentric from the axis of rotation O of rotor 6, vane cam 27 is maintained out of contact with drive shaft 5, and the edge of through hole 27*a* is closer to the axis of rotation O than the distal end portions of back pressure chambers br. This feature serves to seal constantly the distal end portion of each back pressure chamber br even when vane cam 27 is maximally displaced from the axis of rotation O.

The eleven vanes 7 divide an annular place between the outer peripheral surface 60 of rotor 6 and the inner peripheral surface 80 of cam ring 8 and between the z-axis positive direction side surface 410 of pressure plate 41 and the z-axis negative direction side surface 420 of front body 42, to define eleven pumping chambers r. In FIG. 2, rotor 6 rotates in the clockwise direction. The clockwise direction in FIG. 2 is referred to as rotor rotation direction, normal or positive rotational direction, etc., while the counterclockwise direction in FIG. 2 is referred to as rotor reverse rotation direction, negative rotational direction, etc. The distance (or angle) between two adjacent vanes 7 along the rotational direction of rotor 6 is defined as one pitch. Namely, the size of each pumping chamber r in the rotational direction of rotor 6 is equal to one pitch and constant while rotor 6 is rotating.

Under condition that the central axis of cam ring 8 is eccentric from the axis of rotation O of rotor 6 (in the x-axis negative direction in this example), the distance in the rotor radial direction between the outer peripheral surface 60 of rotor 6 and the inner peripheral surface 80 of cam ring 8 gradually increases as followed from the x-axis positive direction side to the x-axis negative direction side. In conformance with this change of the distance between rotor 6 and cam ring 8, each vane 7 moves forward and backward in slot 61 so that the projection of vane 7 from slot 61 changes. Accordingly, the pumping chambers r at the x-axis negative direction side are larger than those at the x-axis positive direction side. Under this condition, in a region below the axis of rotation O of rotor 6, each pumping chamber r expands while traveling from the x-axis positive direction side to the x-axis negative direction side along with rotation of rotor 6. On the other hand, in a region above the axis of rotation O of rotor 6, each pumping chamber r contracts while traveling from the x-axis negative direction side to the x-axis positive direction side along with rotation of rotor 6.

Configuration of Pump Body

<Pressure Plate>

Pressure plate 41 includes a suction port 43*a*, a discharge port 44*a*, a suction-side back pressure port 46*a*, and a discharge-side back pressure port 46*b*, which are formed in the z-axis positive direction side surface 410 of pressure plate 41. Suction port 43*a* serves as an inlet through which working fluid is supplied from the outside into pumping chambers r, and is located in a suction region where each pumping chamber r expands along with rotation of rotor 6. Suction port 43*a* has an arc shape extending around the axis of rotation O through a series of suction-side pumping chambers r. The length of suction port 43*a*, or an angular range from a beginning end at the x-axis positive direction side to a terminating end at the x-axis negative direction side, is substantially equal to 4.5 pitches, which is referred to as suction region. On the other hand, discharge port 44*a* serves as an outlet through which working fluid is drained from pumping chambers r to the outside, and is located in a discharge region where each pumping chamber r contracts along with rotation of rotor 6. Discharge port 44*a* has an arc shape extending around the axis of rotation O through a series of discharge-side pumping chambers r. The length of discharge port 44*a*, or an angular range from a beginning end at the x-axis negative direction side to a terminating end at the x-axis positive direction side, is substantially equal to 4.5 pitches, which is referred to as discharge region. The region between the terminating end of suction port 43*a* and the beginning end of discharge port 44*a* is referred to as first closing region, whereas the region between the terminating end of suction port 43*a* and the beginning end of discharge port 44*a* is referred to as second closing region. Each closing region serves to hydraulically close the pumping chambers r in this region and prevent the suction port 43*a* and discharge port 44*a* from hydraulically communicating with each other through the pumping chambers r. The angular range of each closing region is substantially equal to one pitch.

Pressure plate 41 includes a suction-side back pressure port 46*a* in the suction region and a discharge-side back pressure port 46*b* in the discharge region, where suction-side back pressure port 46*a* is hydraulically connected to the distal end portions of vanes 7 (i.e. back pressure chambers br at the distal end portions of slots 61 of rotor 6) at the suction side, and discharge-side back pressure port 46*b* is hydraulically connected to the distal end portions of vanes 7 at the discharge side, wherein suction-side back pressure port 46*a* is hydraulically separated from discharge-side back pressure port 46*b*. Suction-side back pressure port 46*a* hydraulically connects the suction port 43*a* to back pressure chambers br of vanes 7 in the suction region. Suction-side back pressure port 46*a* is a recess supplied with hydraulic pressure from the suction side of the pump, and has an arc shape extending around the axis of rotation O and through a series of back pressure chambers br of vanes 7. Discharge-side back pressure port 46*b* is hydraulically connected to back pressure chambers br of vanes 7 existing in the discharge region and half sections of the first and second closing regions. Discharge-side back pressure port 46*b* is a recess supplied with hydraulic pressure from the discharge side of the pump, and has an arc shape extending around the axis of rotation O and through a series of back pressure chambers br of vanes 7. Each of suction-side back pressure port 46*a* and discharge-side back pressure port 46*b* is located in a position in a radial direction from the axis of rotation O of rotor 6 to overlap with most part of back pressure chambers br as viewed in the z-axis direction irrespective of the eccentricity of cam ring 8, and hydraulically communicates with overlapping back pressure chambers br. The condition that vane 7 is in the suction region specifically means a condition that the distal end portion of vane 7 is overlapping with the suction port 43*a* as viewed in the z-axis direction. On the other hand, the condition that vane 7 is in the discharge region specifically means a condition that the distal end portion of vane 7 is overlapping with the discharge port 44*a* as viewed in the z-axis direction.

Rear Body

The internal space of rear body 40 is formed with a bearing support hole 40*d*, a low pressure chamber 40*e*, and a high pressure chamber 40*f*. A bush 45 is mounted in the bearing support hole 40*d* of rear body 40, and serves as a bearing for allowing rotation of drive shaft 5. The z-axis negative direction side end portion of drive shaft 5 is mounted inside and rotatably supported by bush 45. The low pressure chamber 40*e* of rear body 40 is hydraulically connected to a reservoir not shown through a reservoir mounting hole 400. The reservoir serves as a hydraulic pressure source for storing working fluid and supplying same to vane pump 1. The pressure of working fluid in the reservoir is substantially equal to atmospheric pressure. The high pressure chamber 40*f* of rear body 40 is formed as a recess in a z-axis negative direction side bottom of housing recess 40*b*, and is hydraulically connected to a discharge passage 30 of a hydraulic circuit 3. Discharge passage 30 is hydraulically connected to a supply passage 34 through a metering orifice 320, wherein hydraulic pressure is supplied through the passage 34 to CVT 100 outside of vane pump 1.

Front Body

The internal space of front body 42 is formed with a bearing support hole 42*d* and a low pressure chamber 42*e*. A bush is mounted in the bearing support hole 42*d*, and serves as a bearing for allowing rotation of drive shaft 5. The z-axis positive direction side end portion of drive shaft 5 is mounted inside and rotatably supported by the bush. The low pressure chamber 42*e* is hydraulically connected to the low pressure chamber 40*e* of rear body 40 through a communication passage 401 formed in rear body 40. Front body 42 includes a suction port 43*b*, a discharge port 44*b*, and a cam port 48, which are formed in the z-axis negative direction side surface 420 of front body 42.

Suction port 43*b* of front body 42 serves as an inlet through which working fluid is supplied from the outside into pumping chambers r, and is located in the suction region where each pumping chamber r expands along with rotation of rotor 6. Suction port 43*b* has an arc shape extending around the axis of rotation O through a series of suction-side pumping chambers r. The length of suction port 43*b*, or an angular range from a beginning end at the x-axis positive direction side to a terminating end at the x-axis negative direction side, is substantially equal to 4.5 pitches, which is referred to as suction region. On the other hand, discharge port 44*b* serves as an outlet through which working fluid is drained from pumping chambers r to the outside, and is located in the discharge region where each pumping chamber r contracts along with rotation of rotor 6. Discharge port 44*b* has an arc shape extending around the axis of rotation O through a series of discharge-side pumping chambers r. The length of discharge port 44*b*, or an angular range from a beginning end at the x-axis negative direction side to a terminating end at the x-axis positive direction side, is substantially equal to 4.5 pitches, which is referred to as discharge region. The region between the terminating end of suction port 43*a* and the beginning end of discharge port 44*a* is referred to as first closing region, whereas the region between the terminating end of suction port 43*a* and the beginning end of discharge port 44*a* is referred to as second closing region. Each closing region serves to hydraulically close the pumping chambers r in this region and prevent the suction port 43*b* and discharge port 44*b* from hydraulically communicating with each other through the pumping chambers r. The angular range of each closing region is substantially equal to one pitch.

Cam port 48 of front body 42 is formed to extend in the inside periphery of circular recess 62 of rotor 6 and has an annular shape extending around the axis of rotation O as a center, and is supplied with hydraulic pressure from the suction side of the pump.

Configuration of Control Section

Vane pump 1 is provided with a control section which includes a first control chamber R1, a second control chamber R2, control valve 2, and hydraulic circuit 3. The space between the housing hole 90 of adapter ring 9 and the outer peripheral surface 81 of cam ring 8 is closed and sealed at the z-axis negative direction side by pressure plate 41 and closed and sealed at the z-axis positive direction side by front body 42, and is divided into the first and second control chambers R1, R2 by the contact portion between the rolling surface 91 of adapter ring 9 and the outer peripheral surface 81 of cam ring 8 and the contact portion between the seal S1 and the outer peripheral surface 81 of cam ring 8. The first control chamber R1 is located on the x-axis negative direction side, wherein the eccentric distance δ of cam ring 8 increases as cam ring 8 moves in the x-axis negative direction. The second control chamber R2 is located on the x-axis positive direction side, wherein the eccentric distance δ of cam ring 8 decreases as cam ring 8 moves in the x-axis positive direction.

Hydraulic circuit 3 includes various passages of working fluid which connect portions of pump body 4 to others, wherein most of the passages are formed in rear body 40. Rear body 40 includes a valve-housing hole 40*a* which has a cylindrical shape and extends in the x-axis direction. The spool 20 of control valve 2 is mounted in the valve-housing hole 40*a* of rear body 40. The discharge passage 30 is hydraulically connected to discharge port 44 (discharge port 44*a* and/or discharge port 44*b*) of the pumping section, and is branched into a first control source pressure passage 31 and a discharge passage 32.

First control source pressure passage 31 has an opening at the x-axis negative direction side of valve-housing hole 40*a* through which a base pressure is supplied to control valve 2 for generating a control pressure for controlling the eccentric distance δ of cam ring 8 and thereby controlling pump displacement, wherein the base pressure is substantially equal to the discharge pressure supplied from discharge port 44. Discharge passage 32 is provided with a metering orifice 320 which has a smaller cross sectional flow area than the other portion of discharge passage 32. Discharge passage 32 is branched at a portion downstream of metering orifice 320 into a second control source pressure passage 33 and a supply passage 34. Supply passage 34 is configured to supply CVT 100 with a supply pressure that is a pressure after pressure reduction through the metering orifice 320 from the discharge pressure from discharge port 44. Second control source pressure passage 33 has an opening at the x-axis positive direction side of valve-housing hole 40*a* through which a second base pressure is supplied to control valve 2 for generating a control pressure for controlling the eccentric distance δ of cam ring 8, wherein the second base pressure is substantially equal to the supply pressure.

The first control passage 35 has an opening on the x-axis positive direction side of valve-housing hole 40*a*, which opening is next to the opening of first control source pressure passage 31. First control passage 35 is hydraulically connected to the first control chamber R1 of the pumping section through a through hole 92 which extends through the wall of adapter ring 9 in a radial direction of adapter ring 9. Also, the second control passage 36 has an opening on the x-axis negative direction side of valve-housing hole 40*a*, which opening is next to the opening of second control source pressure passage 33. Second control passage 36 is hydraulically connected to the second control chamber R2 of the pumping section through another through hole 93 which extends through the wall of adapter ring 9 in a radial direction of adapter ring 9.

Control valve 2 is a hydraulic pressure control valve in the form of a spool valve, which operates or moves the spool 20 as a valve element, and thereby switches supply of working fluid to the first and second control chambers R1, R2. Control valve 2 includes spool 20 and a coil spring 21. Spool 20 is mounted in valve-housing hole 40*a* of rear body 40 and configured to travel in the x-axis direction. Coil spring 21 is mounted in compressed state on the x-axis positive direction of spool 20 in valve-housing hole 40*a*, so that coil spring 21 constantly biases the spool 20 in the x-axis negative direction. The x-axis positive direction side end portion of coil spring 21 is retained by a retainer 22 that is screwed in a thread portion 40*c* that is formed in the x-axis positive direction side of valve-housing hole 40*a*.

Control valve 2 is an electromagnetic valve including a solenoid SOL. Operation of control valve 2 (i.e. displacement of spool 20) is controlled by a difference between a first hydraulic pressure and a second hydraulic pressure wherein the first hydraulic pressure is applied to a first end surface of spool 20 and the second hydraulic pressure is applied to a second end surface of spool 20, and also controlled by a thrust applied from solenoid SOL to spool 20 which is controlled in conformance with a control command from CVT control unit 130.

Spool 20 includes a first large-diameter portion 201 and a second large-diameter portion 202, each of which serves to shut off a corresponding port or adjust the opening of the corresponding port. The first large-diameter portion 201 is located at an x-axis negative direction side portion of spool 20, while second large-diameter portion 202 is located at an x-axis positive direction side end portion of spool 20. Each large-diameter portion 201, 202 has a cylindrical shape having an outer diameter that is substantially equal to the inner diameter of the cylindrical valve-housing hole 40*a* of rear body 40.

The internal space of valve-housing hole 40*a* of rear body 40 is divided into a first pressure chamber 23 by first large-diameter portion 201 of spool 20 and the x-axis positive direction side end portion of solenoid SOL, and into a second pressure chamber 24 by second large-diameter portion 202 of spool 20 and the x-axis positive direction side end portion of valve-housing hole 40*a*, and into a drain chamber 25 by first large-diameter portion 201 and second large-diameter portion 202 of spool 20. Irrespective of the position or displacement of spool 20, first pressure chamber 23 is constantly hydraulically connected to first control source pressure passage 31, whereas second pressure chamber 24 is constantly hydraulically connected to second control source pressure passage 33. On the other hand, drain chamber 25 is constantly hydraulically connected to a drain passage not shown so that the internal pressure of drain chamber 25 is maintained low, and specifically, drain chamber 25 is subject to atmospheric pressure.

Movement of spool 20 in the x-axis direction causes changes in the area of part of the opening of first control passage 35 closed by first large-diameter portion 201 and the area of part of second control passage 36 closed by second large-diameter portion 202, and thereby switches each control passage 35, 36 between open state and closed state. Each opening is arranged as follows. When spool 20 is maximally displaced in the x-axis negative direction, the opening of first control passage 35 is hydraulically disconnected from first pressure chamber 23 by first large-diameter portion 201, and hydraulically connected to drain chamber 25. Under this condition, the opening of second control passage 36 is hydraulically disconnected from drain chamber 25 by second large-diameter portion 202, and hydraulically connected to second pressure chamber 24. As spool 20 travels in the x-axis positive direction from that position, the opening of first control passage 35 gets hydraulically disconnected from drain chamber 25, and hydraulically connected to first pressure chamber 23 when the movement exceeds a specific threshold. As the displacement of spool 20 in the x-axis positive direction further increases, the area of part of the opening of first control passage 35 closed by first large-diameter portion 201 decreases. On the other hand, as spool 20 travels in the x-axis positive direction, the area of part of the opening of second control passage 36 closed by second large-diameter portion 202 increases. Then, when the displacement of spool 20 exceeds a specific threshold, the opening of second control passage 36 gets hydraulically disconnected from second pressure chamber 24.

When spool 20 is maximally displaced in the x-axis positive direction, the opening of first control passage 35 is hydraulically disconnected from drain chamber 25 by first large-diameter portion 201, and hydraulically connected to first pressure chamber 23. Under this condition, the opening of second control passage 36 is hydraulically disconnected from second pressure chamber 24 by second large-diameter portion 202, and hydraulically connected to drain chamber 25.

Solenoid SOL is configured to press a plunger 2*a* in the x-axis positive direction by a thrust that depends on an energizing current that is generated in response to a control command from CVT control unit 130. The configuration that the x-axis positive direction side end of plunger 2*a* is in contact with the x-axis negative direction side end of spool 20, and spool 20 is biased in the x-axis positive direction by an electromagnetic force of solenoid SOL, produces the same effects as the configuration that the initial set load of coil spring 21 is set smaller. Under control of solenoid SOL, spool 20 can be moved by a smaller differential pressure at earlier timing than under a condition where solenoid SOL is inoperative, to achieve a relatively low rate of discharge of working fluid, and then maintain the rate of discharge constant. In this way, the discharge flow rate is controlled by the biasing force generated by solenoid SOL. CVT control unit 130 is configured to apply a desired effective current to solenoid SOL and change the driving force of plunger 2*a* continuously, for example, by a PWM control of solenoid SOL in which the pulse width of driving power is adjusted. CVT control unit 130 is configured to control the line pressure depending on operating state of the vehicle such as accelerator opening, engine speed, and vehicle speed. When the discharge flow rate is requested to be high, CVT control unit 130 reduces or stops the energizing current applied to solenoid SOL. On the other hand, when the discharge flow rate is requested to be low, CVT control unit 130 increases the energizing current applied to solenoid SOL.

Operation of Vane Pump

The following describes operation of vane pump 1 according to the first embodiment.

Pumping Operation

When rotor 6 is rotated under condition that cam ring 8 is made eccentric in the x-axis negative direction with respect to the axis of rotation O, each pumping chamber r expands and contracts periodically while rotating around the axis of rotation O. In the suction region where each pumping chamber r expands along with rotation of rotor 6, pumping chamber r is supplied with working fluid through the suction port 43 (suction port 43*a* and/or suction port 43*b*). In the discharge region where each pumping chamber r contracts along with rotation of rotor 6, pumping chamber r discharges working fluid through the discharge port 44 (discharge port 44*a* and/or discharge port 44*b*). Specifically, when one pumping chamber r is followed, pumping chamber r continues to expand until the rear vane 7 (vane 7 on the rotor reverse rotation side of pumping chamber r) passes through the terminating point of suction port 43, in other words, until the front vane 7 (vane 7 on the rotor rotation side of pumping chamber r) passes through the beginning point of discharge port 44. During this period, pumping chamber r is hydraulically connected to suction port 43, to suck working fluid through the suction port 43.

In the first closing region, rotor 6 is in such a position that the rotor rotation side surface of the rear side vane 7 of pumping chamber r is identical to the terminating point of suction port 43 and the rotor reverse rotation side surface of the front side vane 7 is identical to the beginning end of discharge port 44, so that pumping chamber r is hydraulically separated from suction port 43 and discharge port 44 and thereby maintained liquid-tight. After the rear side vane 7 passes through the terminating point of suction port 43, namely, after the front side vane 7 passes through the beginning end of discharge port 44, pumping chamber r reaches the discharge region where pumping chamber r contracts along with rotation of rotor 6 and gets hydraulically connected to discharge port 44, and thereby discharges working fluid to discharge port 44. Similarly, in the second closing region, rotor 6 is in such a position that the rotor rotation side surface of the rear side vane 7 of pumping chamber r is identical to the terminating point of discharge port 44 and the rotor reverse rotation side surface of the front side vane 7 is identical to the beginning end of suction port 43, so that pumping chamber r is hydraulically separated from suction port 43 and discharge port 44 and thereby maintained liquid-tight. In the first embodiment, each closing region has an angular range of one pitch which is equal to that of one pumping chamber r. This feature serves to prevent fluid communication between the suction region and the discharge region, and also allow the ranges of the suction region and the discharge region to be maximized, and thereby enhance the pumping efficiency. However, the range of each closing region between suction port 43*a*, 43*b* and discharge port 44*a*, 44*b* may be set greater than one pitch.

Variable Displacement of Vane Pump

When the eccentric distance δ of cam ring 8 in the x-axis negative direction with respect to rotor 6 is non-zero, each pumping chamber r in the suction region expands along with rotation of rotor 6, and gets maximized when the pumping chamber r is in the first closing region. On the other hand, each pumping chamber r in the discharge region contracts along with rotation of rotor 6, and gets minimized in the second closing region. When the eccentric distance δ of cam ring 8 is maximized as shown in FIG. 2, the difference in volumetric capacity between the pumping chamber r in maximally contracted state and the pumping chamber r in maximally expanded state is maximized, so that the pump displacement is maximized. On the other hand, when the eccentric distance δ of cam ring 8 in the x-axis negative direction with respect to rotor 6 is minimized to zero, the volumetric capacity of pumping chamber r is maintained constant when rotor 6 is rotating in the suction region and also in the discharge region. In other words, all of the pumping chambers r have the same volumetric capacity, so that the pump displacement is minimized. In this way, the pump displacement is varied according to the difference in volumetric capacity which varies according to the eccentric distance δ of cam ring 8.

Vane pump 1 includes control valve 2 for controlling variable pump displacement. Control valve 2 receives supply of hydraulic pressure from discharge port 44 and produces a control pressure based on the supplied pressure for controlling the eccentric distance δ of cam ring 8. Specifically, working fluid is compressed in pumping chambers r in the discharge region, and then supplied to high pressure chamber 40*f* through the discharge port 44. The working fluid in high pressure chamber 40*f* is supplied to the first pressure chamber 23 of control valve 2 through the discharge passage 30 and first control source pressure passage 31, and supplied to the second pressure chamber 24 of control valve 2 through the discharge passage 30, discharge passage 32, and second control source pressure passage 33.

The first control chamber R1 receives supply of working fluid as control pressure from the first pressure chamber 23 of control valve 2 through the first control passage 35, and produces a first hydraulic pressure for pressing the cam ring 8 in the x-axis positive direction against the biasing force of coil spring SPG. The second control chamber R2 receives supply of working fluid as control pressure from the second pressure chamber 24 of control valve 2 through the second control passage 36, and produces a second hydraulic pressure for pressing the cam ring 8 in the x-axis negative direction in addition to the biasing force of coil spring SPG.

When the force resulting from the first and second hydraulic pressures in control valve 2 is in the direction to press the cam ring 8 in the x-axis positive direction and the resulting force is larger than the biasing force of coil spring SPG pressing the cam ring 8 in the x-axis negative direction, then cam ring 8 is caused to travel in the x-axis positive direction. This travel causes a decrease in the eccentric distance δ of cam ring 8, and thereby causes a decrease in the difference in volumetric capacity of pumping chamber r between the compressed state and the expanded state, and thereby causes a decrease in the pump displacement. Conversely, when the force resulting from the first and second hydraulic pressures in control valve 2 is in the direction to press the cam ring 8 in the x-axis positive direction but the resulting force is smaller than the biasing force of coil spring SPG pressing the cam ring 8 in the x-axis negative direction, or when the resulting force is in the direction to press the cam ring 8 in the x-axis negative direction, then cam ring 8 is caused to travel in the x-axis negative direction. This travel causes an increase in the eccentric distance δ of cam ring 8, and thereby causes an increase in the difference in volumetric capacity of pumping chamber r between the compressed state and the expanded state, and thereby causes an increase in the pump displacement. Under condition that no working fluid is supplied to the first and second control chambers R1, R2, cam ring 8 is pressed by coil spring SPG in the x-axis negative direction, so that the eccentric distance δ of cam ring 8 is maximized. It is optional to omit the second control chamber R2 and control the eccentric distance δ only by the hydraulic pressure of the first control chamber R1. The coil spring SPG may be replaced with another elastic member for biasing the cam ring 8.

Control valve 2 is configured to switch supply of control pressure depending on the displacement of spool 20. Specifically, when spool 20 is displaced in the x-axis positive direction, control valve 2 supplies working fluid as control pressure from first pressure chamber 23 to the first control chamber R1 through the first control passage 35. Conversely, when spool 20 is displaced in the x-axis negative direction, control valve 2 supplies working fluid as control pressure from second pressure chamber 24 to the second control chamber R2 through the second control passage 36. Spool 20 is configured to receive hydraulic pressures (first and second hydraulic pressures) supplied by discharge port 44, and travel in response to the received hydraulic pressures. This feature allows to simplify the structure, because control valve 2 can mechanically operate in response to operation of the pumping section that is a controlled object, so that no additional control means is required for controlling the operation of control valve 2. Specifically, when the rotational speed of rotor 6 is greater than zero and smaller than or equal to a specific value α, the first and second hydraulic pressures act on spool 20 in the x-axis negative direction so that the spool 20 travels in the x-axis negative direction to supply a control pressure to increase the eccentric distance δ of cam ring 8. On the other hand, when the rotational speed of rotor 6 is greater than the specific value α, the first and second hydraulic pressures acts on spool 20 in the x-axis positive direction so that the spool 20 travels in the x-axis positive direction to supply a control pressure to decrease the eccentric distance δ of cam ring 8. In this way, the pump displacement is mechanically controlled so that the pump displacement increases when vane pump 1 is rotating at low speed, and decreases when vane pump 1 is rotating at high speed.

More specifically, when the rotational speed of rotor 6 is greater than zero and smaller than or equal to the specific value α, the position of spool 20 is controlled so that the opening of first control passage 35 is closed by first large-diameter portion 201 and thereby is hydraulically disconnected from the first pressure chamber 23. On the other hand, when the rotational speed of rotor 6 is greater than the specific value α, the position of spool 20 is controlled so that the opening of first control passage 35 is not closed by first large-diameter portion 201 but is hydraulically connected to the first pressure chamber 23. In this way, the pump displacement is mechanically controlled so that the pump displacement increases when vane pump 1 is rotating at low speed, and decreases when vane pump 1 is rotating at high speed.

The second control passage 36 has an opening in the wall of valve-housing hole 40*a*, and is configured to supply a control pressure for increasing the eccentric distance δ of cam ring 8. When the rotational speed of rotor 6 is greater than zero and smaller than or equal to the specific value α, the opening of second control passage 36 is not closed by second large-diameter portion 202 but hydraulically connected to second pressure chamber 24. When the rotational speed of rotor 6 is greater than the specific value α, the opening of second control passage 36 is closed by second large-diameter portion 202 and hydraulically disconnected from second pressure chamber 24. In this way, the pump displacement is mechanically controlled so that the pump displacement increases when vane pump 1 is rotating at low speed, and decreases when vane pump 1 is rotating at high speed.

The discharge passage 32 is provided with metering orifice 320, wherein the discharge passage 32 supplies pressure (base pressure for generating control pressure) from discharge port 44 to second pressure chamber 24, and metering orifice 320 produces a differential pressure that increases as the flow rate of working fluid through the metering orifice 320 increases. Accordingly, second pressure chamber 24 is supplied with lower pressure than the discharge pressure. On the other hand, the first control source pressure passage 31 is provided with no orifice, wherein the first control source pressure passage 31 supplies pressure (base pressure for generating control pressure) from discharge port 44 to first pressure chamber 23. Accordingly, first pressure chamber 23 is supplied with a pressure substantially identical to the discharge pressure. This feature cause a differential pressure of working fluid between the first control chamber R1 and second control chamber R2, wherein the differential pressure determines the eccentric distance δ of cam ring 8. This allows to easily achieve an automatic control of reducing the pump displacement. In the first embodiment, the structure is simplified by the feature that the means for producing the differential pressure is implemented by metering orifice 320. However, it is optional to omit the second pressure chamber 24, and control the eccentric distance δ of cam ring 8 only by first pressure chamber 23. In such cases, spool 20 can be displaced by the biasing force of coil spring 21 and the hydraulic pressure of first pressure chamber 23.

CVT control unit 130 is configured to control operation of control valve 2 by solenoid SOL, to control the displacement of spool 20, and switch supply of working fluid to the first and second control chambers R1, R2, and thereby control the first and second hydraulic pressures. CVT control unit 130 can control arbitrarily the pump displacement, for example, depending on the operating state of CVT 100, independently of the rotational speed of vane pump 1 (or the engine rotational speed) on which the foregoing mechanical control of the pump displacement is based. Control valve 2 is not limited to an electromagnetic valve actuated by solenoid SOL, but may be configured without solenoid SOL. The feature that vane pump 1 is configured as described above for arbitrarily controlling the pump displacement, serves to minimize the torque required to drive the pump while maintaining the pump output as requested. This serves to reduce loss torques or power losses as compared to cases of constant displacement pumps.

Reduction of Power Loss by Separation Between Back Pressure Ports

When rotor 6 is rotating, vanes 7 are subject to centrifugal forces to press vanes 7 outwardly in radial directions. When the rotational speed of rotor 6 is sufficiently high and a specific condition is satisfied, the distal end portion of each vane 7 projects from slot 61 and gets into sliding contact with the inner peripheral surface 80 of cam ring 8. The contact between the distal end portion of vane 7 and the inner peripheral surface 80 of cam ring 8 restricts the outward movement of vane 7 in the radial direction of rotor 6. The projection of vane 7 from slot 61 causes an increase in the volumetric capacity of back pressure chamber br of vane 7, whereas the rearward movement of vane 7 into slot 61 causes a decrease in the volumetric capacity of back pressure chamber br of vane 7. When rotor 6 is rotating under condition that the cam ring 8 is made eccentric in the x-axis negative direction with respect to the axis of rotation O, the back pressure chamber br of each vane 7 in sliding contact with the inner peripheral surface 80 of cam ring 8 periodically expands and contracts while rotating about the axis of rotation O. If no working fluid is supplied to the back pressure chamber br in the suction region where back pressure chamber br expands, it is possible that vane 7 is pretended from projecting from slot 61, and the distal end of vane 7 gets out of contact with the inner peripheral surface 80 of cam ring 8, and the liquid tightness of pumping chamber r is not maintained. On the other hand, if no working fluid is drained from the back pressure chamber br in the discharge region where back pressure chamber br contracts, it is possible that vane 7 is pretended from moving backward into slot 61, and the distal end of vane 7 gets pressed on the inner peripheral surface 80 of cam ring 8, and the resistance to sliding is increased. This problem is solved by the configuration that back pressure chambers br in the suction region are supplied with working fluid from suction-side back pressure port 46*a* so that the ability of projection of vanes 7 is enhanced, and also by the configuration that back pressure chambers br in the discharge region are allowed to discharge working fluid to discharge-side back pressure port 46*b* so that the resistance to sliding of vanes 7 is prevented from increasing excessively.

More specifically, when in the suction region, the distal end portion of each vane 7 is subject to pressure from suction port 43, and the proximal end portion of vane 7 is subject to pressure from suction-side back pressure port 46*a*. The pressure in suction port 43 and the pressure in suction-side back pressure port 46*a* are relatively low, because both are hydraulically connected commonly to low pressure chamber 40*e* and low pressure chamber 42*e*. Accordingly, the difference between the force applied to the distal end portion of vane 7 and the force applied to the proximal end portion of vane 7 is relatively small. More specifically, working fluid is supplied from the reservoir through low pressure chamber 40*e* and low pressure chamber 42*e* to suction ports 43*a*, 43*b* through communication passage 412 and communication passage 422 and to suction-side back pressure port 46*a* through communication passage 413. During operation of vane pump 1, working fluid continues to be supplied when in the suction region so that the pressure (suction pressure) in suction ports 43*a*, 43*b* is a negative pressure, namely, is below atmospheric pressure. On the other hand, during operation of vane pump 1, suction-side back pressure port 46*a* is hydraulically connected to suction ports 43*a*, 43*b* through low pressure chamber 40*e* and low pressure chamber 42*e* so that suction-side back pressure port 46*a* is supplied with a pressure close to the suction pressure from communication passage 413.

On the other hand, when in the discharge region, the distal end portion of each vane 7 is subject to pressure from discharge port 44, and the proximal end portion of vane 7 is subject to pressure from discharge-side back pressure port 46*b*. The pressure in discharge port 44 and the pressure in discharge-side back pressure port 46*b* are relatively high, because both are hydraulically connected commonly to high pressure chamber 40*f* through the communication passage 414 and communication passage 415. Accordingly, the difference between the force applied to the distal end portion of vane 7 and the force applied to the proximal end portion of vane 7 is relatively small. More specifically, during operation of vane pump 1, working fluid continues to be pressurized by the pumping function when in the discharge region so that the pressure (discharge pressure) in discharge ports 44*a*, 44*b* is a positive pressure, namely, is above atmospheric pressure. On the other hand, during operation of vane pump 1, discharge-side back pressure port 46*b* is hydraulically connected to discharge ports 44*a*, 44*b* through high pressure chamber 40*f* so that discharge-side back pressure port 46*b* is supplied with a pressure close to the discharge pressure. Accordingly, the distal end portion of vane 7 is prevented from being made to contact unnecessarily hard the inner peripheral surface 80 of cam ring 8, so that the loss torque resulting from friction of sliding contact between vane 7 and cam ring 8 is prevented from getting high.

In that way, the feature that vane pump 1 is provided with suction-side back pressure port 46*a* and discharge-side back pressure port 46*b* which are separated from each other, serves to suppress the differential pressure between the distal end and proximal end of each vane 7 during suction operation and during discharge operation from getting as large as the differential pressure between the suction pressure and discharge pressure. This feature serves to press each vane 7 onto cam ring 8 by a suitable force resulting from centrifugal force while minimizing the resistance to sliding between vane 7 and cam ring 8. This results in a decrease in wear of the contact surfaces, a decrease in the driving torque for rotating the rotor 6, and thereby a decrease in the power loss. In other words, vane pump 1 is a compact and highly efficient vane pump with a low required driving torque with respect to rotational speed, with a power loss reduced and thereby a fuel efficiency enhanced, and with a large displacement with respect to apparatus size, as compared to typical variable displacement vane pumps.

Noise Suppression by Provision of Vane Cam

Although vane pump 1 has the configuration that working fluid is supplied to back pressure chambers br from suction-side back pressure port 46*a* in the suction region as described above, it is possible that the force acting on the vane 7 outwardly in the radial direction is relatively small because the centrifugal force is small when vane pump 1 is rotating at low speed, for example, when the engine is at start or at idle. This may cause a problem that when the rotor is rotating at low speed, the projection of vane 7 during the suction process is insufficient so that the distal end portion of vane 7 gets out of contact with the inner peripheral surface 80 of cam ring 8. If this condition is followed by a situation that the back pressure chamber br of vane 7 begins to enter the region of discharge-side back pressure port 46*b*, then the proximal end portion of vane 7 begins to be subject to a rapid increase in pressure so that vane 7 may be pressed hard to project and collide hard with cam ring 8, and thereby cause noise.

Figure 4:
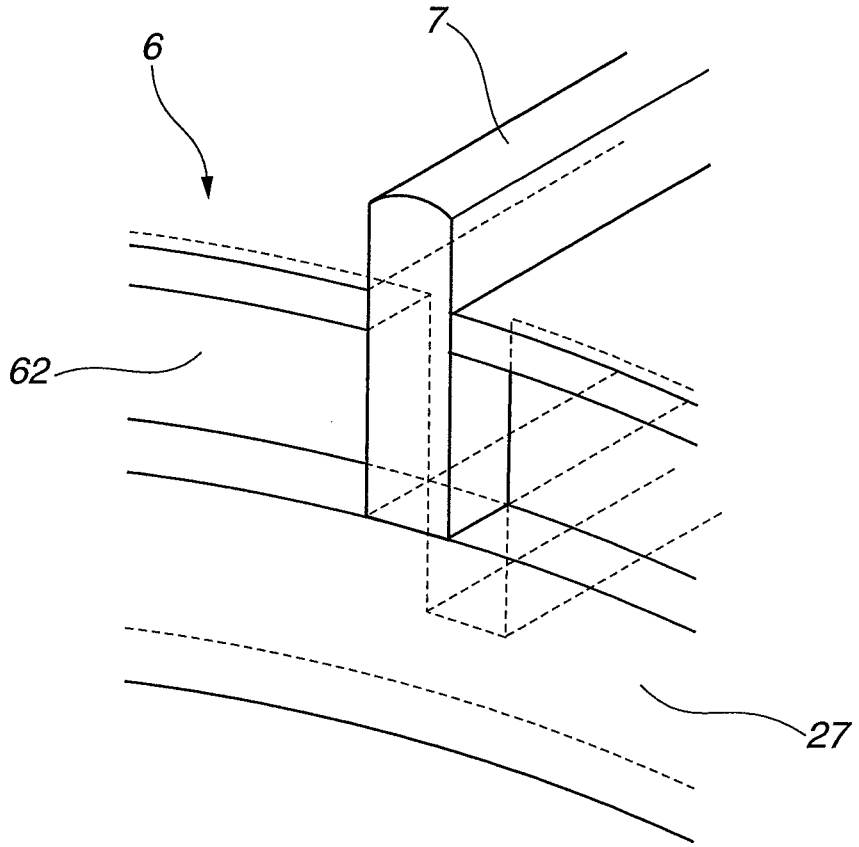
FIG. 4 is a schematic diagram showing configuration of the rotor, a vane and a vane cam of the vane pump according to the first embodiment.

In the first embodiment, vane pump 1 is provided with vane cam 27 that is arranged on the z-axis positive direction side of rotor 6. Vane cam 27 has an outer diameter that is smaller by twice the length of vane 7 than the diameter of the inner peripheral surface 80 of cam ring 8. Vane cam 27 is configured to move with respect to rotor 6 to be eccentric with respect to rotor 6 similar to cam ring 8 so that the outer peripheral surface of vane cam 27 is constantly in contact with the distal end portion of each vane 7. FIG. 4 schematically shows configuration of rotor 6, vanes 7 and vane cam 27 of the vane pump according to the first embodiment. Vane cam 27 swings along with swinging motion of cam ring 8, to be eccentric with respect to rotor 6, and press the proximal end portion of vane 7 outwardly in the radial direction. Vane cam 27 constantly and sufficiently forces vanes 7 to project and contact the inner peripheral surface 80 of cam ring 8, and thereby prevent the occurrence of noise, even when the rotor 6 is rotating at low speed, for example, at start or at idle so that the vane 7 cannot be moved sufficiently only by the centrifugal force.

Stable Support of Drive Shaft

It is preferable that drive shaft 5 is rotatably supported on both sides of rotor 6. In the first embodiment, vane cam 27 has the through hole 27*a* at the center of vane cam 27, wherein through hole 27*a* extends in the z-axis direction through the thickness of vane cam 27. The inside diameter of through hole 27*a* is set so that vane cam 27 is constantly out of contact with drive shaft 5 even when vane cam 27 is most eccentric with respect to drive shaft 5. This configuration allows to rotatably support the both ends of drive shaft 5, and thereby stably support drive shaft 5.

Sealing Function of Vane Cam

The slots 61 and back pressure chambers br of rotor 6 are supplied with the pressure from suction-side back pressure port 46*a* when in the suction region, and supplied with the pressure from discharge-side back pressure port 46*b* when in the discharge region. Accordingly, also at the boundary where vane cam 27 and rotor 6 are in contact with each other, the slots 61 and back pressure chambers br in the suction region are sealed and separated from those in the discharge region. Specifically, the inside diameter of through hole 27*a* is set small so that even when vane cam 27 is most eccentric with respect to rotor 6, the inside periphery of vane cam 27 is closer to the center of rotor 6 than the proximal ends of back pressure chambers br. In this way, even when vane cam 27 is most eccentric with respect to rotor 6, the proximal end portion of each back pressure chamber br is sealed from outside. On the other hand, the thickness of vane cam 27 is set maximized within the depth of circular recess 62 of rotor 6 and within such a range that movement of vane cam 27 is not restricted with respect to rotor 6. The length of vane 7 is set maximized within such a range that vane 7 is movable between cam ring 8 and vane cam 27. In this configuration, the slots 61 and back pressure chambers br in the suction region are separated and suitably sealed from those in the discharge region.

Operation of Cam Port

At the outer periphery of vane cam 27 is formed vane cam chambers cr corresponding to vanes 7, wherein the number of vane cam chambers cr is equal to the number of vanes 7. Each vane cam chamber cr is defined by vane cam 27, circular recess 62 of rotor 6, two adjacent vanes 7, and pump body 4. The volumetric capacity of each vane cam chamber cr changes along with rotation of rotor 6. Specifically, when in the suction region, the volumetric capacity of vane cam chamber cr gradually decreases along with rotation of rotor 6. When in the discharge region, the volumetric capacity of vane cam chamber cr gradually increases along with rotation of rotor 6. The total decrease in volumetric capacity of vane cam chambers cr in the suction region is equal to the total increase in volumetric capacity of vane cam chambers cr in the discharge region.

If no working fluid is supplied to or drained from vane cam chambers cr along with changes in volumetric capacity of vane cam chambers cr, then vane cam chambers cr are closed so that rotor 6 may be locked. This problem is addressed by a feature that the z-axis negative direction side surface 420 of front body 42 is formed with a cam port 48 facing the circular recess 62 of rotor 6, wherein cam port 48 allows working fluid to flow into and out of vane cam chambers cr. Cam port 48 extends all along the circumference around the axis of rotation O, and is supplied with the suction pressure that is pressure from the suction side of the pump. Along with rotation of rotor 6, almost all of working fluid discharged by contraction of vane cam chambers cr during the suction process flows through the cam port 48 into vane cam chambers cr that are expanding during the discharge process. The internal pressure of cam port 48 is maintained at the suction pressure, because cam port 48 is supplied with the suction pressure. In this way, working fluid is prevented from being closed within vane cam chambers cr, and rotor 6 is thereby prevented from rotating.

Figure 5A:
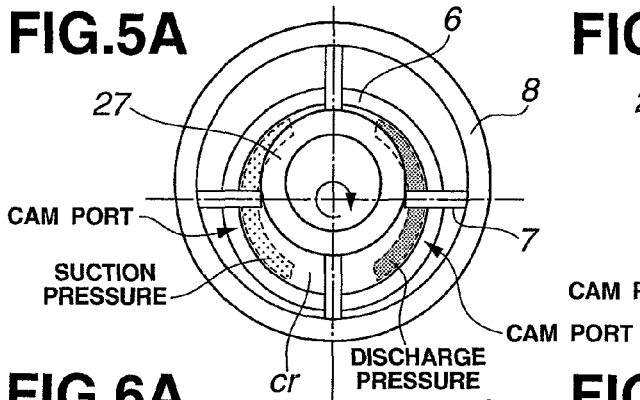
FIGS. 5A and 5B are schematic diagrams showing two different conditions of a configuration according to a first option for formation of cam port.
Figure 8A:
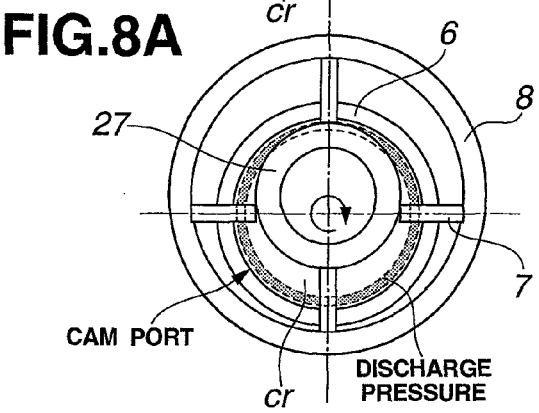
FIGS. 8A and 8B are schematic diagrams showing two different conditions of a configuration according to a fourth option for formation of cam port.
Figure 8B:
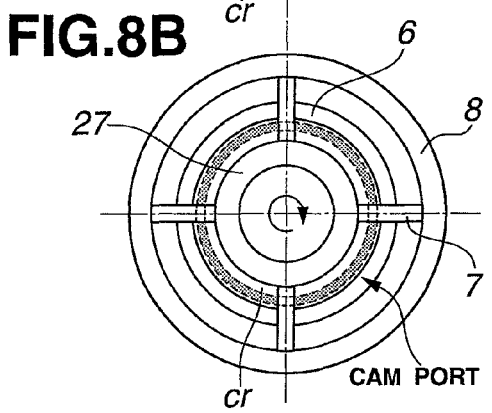

Reduction of Force Acting on Vane Cam, and Suppression of Increase of Driving Torque FIGS. 5A to 8B schematically show four different options for formation of cam port 48 which serves to supply working fluid to vane cam chambers cr. For ease of understanding, each of FIGS. 5A to 8B shows four representative vanes 7 only. In the first embodiment, cam port 48 is formed in pump body 4 to extend entirely along the circumference around the axis of rotation O, and is supplied with the suction pressure, as described above. However, there are at least the following four options about formation of cam port 48. The first option is that cam port 48 is composed of two separate parts, i.e. a first part in the suction region and a second part in the discharge region, wherein the first part is supplied with the suction pressure and the second part is supplied with the discharge pressure as shown in FIGS. 5A and 5B. The second option is that cam port 48 is an annular part extending along the entire circumference, and is supplied with the suction pressure as shown in FIGS. 6A and 6B, which is adopted as the first embodiment. The third option is that cam port 48 is an annular part extending along the entire circumference, and is not directly supplied with the suction pressure nor the discharge pressure, but supplied with an intermediate pressure between the suction pressure and the discharge pressure, as shown in FIGS. 7A and 7B. The fourth option is that cam port 48 is an annular part extending along the entire circumference, and is supplied with the discharge pressure, as shown in FIGS. 8A and 8B. FIG. 9 is a table which summarizes effects produced by the first to fourth options of FIGS. 5A to 8B in view of pressure around the vane cam, forces acting on the vane cam, and driving torque affected by friction. In the table, the numbers 1 to 4 mean levels of significance of effect in ascending order.

Option 1

<Pressure on Periphery of Vane Cam>

Since the first part of cam port 48 is supplied with the suction pressure and the second part of cam port 48 is supplied with the discharge pressure, part of the outer periphery of vane cam 27 in the suction region is subject to the suction pressure, whereas part of the outer periphery of vane cam 27 in the discharge region is subject to the discharge pressure.

Force on Vane Cam in Radial Direction

Figure 5B:
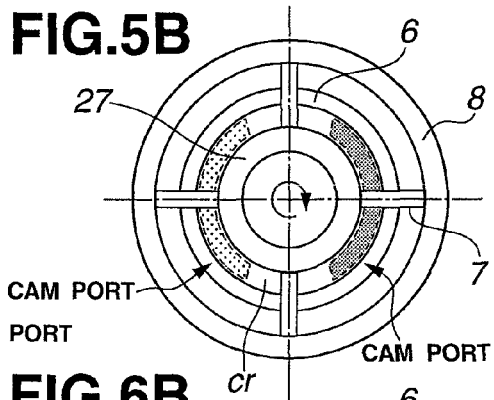
Figure 6A:
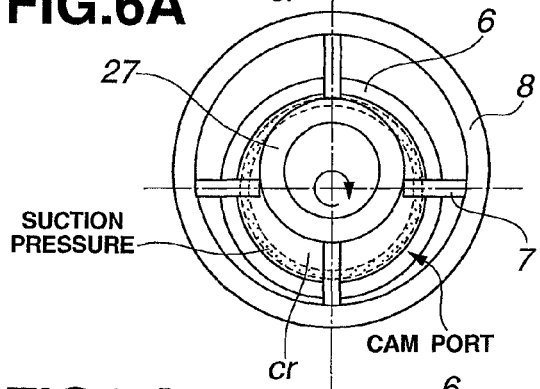
FIGS. 6A and 6B are schematic diagrams showing two different conditions of a configuration according to a second option for formation of cam port.
Figure 6B:
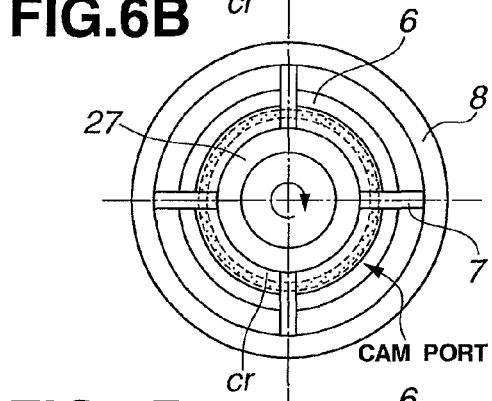
Figure 7A:
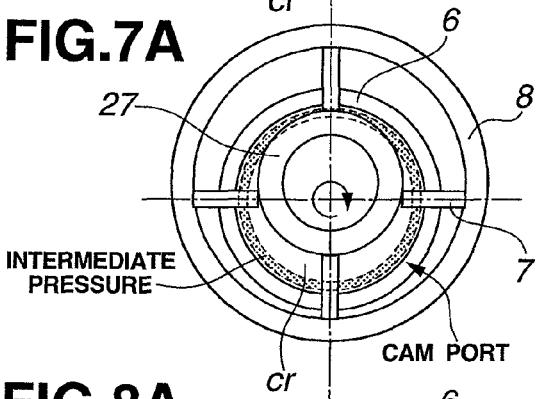
FIGS. 7A and 7B are schematic diagrams showing two different conditions of a configuration according to a third option for formation of cam port.
Figure 7B:
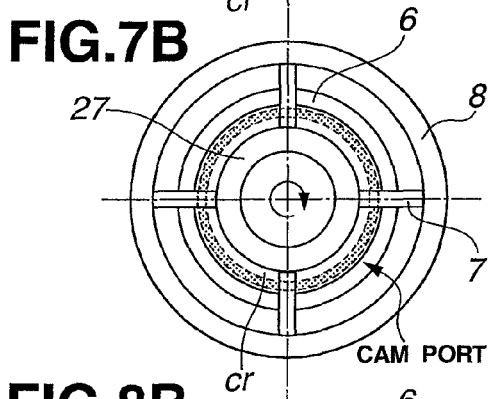

The condition that part of the outer periphery of vane cam 27 in the suction region is applied with the suction pressure, whereas part of the outer periphery of vane cam 27 in the discharge region is applied with the discharge pressure, results in that the entire vane cam 27 is subject to a resulting force in a direction from the discharge region side to the suction region side (leftward in FIGS. 5A and 5B). This resulting force is received by vanes 7 located in the suction region side. Most part of the resulting force is received by one or two vanes 7, although the number of involved vanes 7 depends on the rotational position of rotor 6. Accordingly, it is appropriate to enhance the durability of the contact surfaces of vanes 7 contacting the inner peripheral surface 80 of cam ring 8, and also enhance the strength of vane cam 27.

Force on Vane Cam in Axial Direction

Vane cam 27 seals the slots 61 and back pressure chambers br of rotor 6, so that vane cam 27 is subject to hydraulic pressure in the axial direction of vane cam 27 or rotor 6. However, the first part of cam port 48 is supplied with the suction pressure and the second part of cam port 48 is supplied with the discharge pressure, so that the applied forces are in balance and the vane cam 27 is subject to little force in the axial direction.

Effect on Driving Torque

The condition that the vane cam 27 is subject to little force in the axial direction results in that the friction between vane cam 27 and pump body 4 is small to have little effect on the driving torque. However, the force acting on the vane cam 27 in the radial direction presses vane 7 on the cam ring 8 and thereby causes a small increase in the driving torque.

Option 2

<Pressure on Periphery of Vane Cam>

Since the entire part of cam port 48 is supplied with the suction pressure, the entire outer periphery of vane cam 27 is subject to the suction pressure.

Force on Vane Cam in Radial Direction

The condition that the entire outer periphery of vane cam 27 is applied with the suction pressure, results in that the entire vane cam 27 is subject to no direct force in radial directions. However, when in the suction region, the distal end portion of vane 7 is subject to the discharge pressure and the proximal end portion of vane 7 in contact with the vane cam 27 is subject to the suction pressure, so that the vane 7 is applied with a resulting force inward in the radial direction. This resulting force is received by vane cam 27. The force applied to vane cam 27 is smaller than in the option 1, because the area of the distal end portion of vane 7 is smaller than the substantially half of the outer peripheral surface of vane cam 27 that is applied with the force in the option 1.

Force on Vane Cam in Axial Direction

Vane cam 27 seals the slots 61 and back pressure chambers br of rotor 6, so that vane cam 27 is subject to hydraulic pressure in the axial direction of vane cam 27 or rotor 6. Accordingly, when in the discharge region, vane cam 27 is pressed onto front body 42. In FIG. 9, this effect is estimated as level 3, because vane cam 27 is pressed on the stationary front body 42 wherein the pressing force has a smaller effect than in the case of the option 4 detailed below in which vane cam 27 is pressed on the rotating vanes 7, wherein the level 4 is given to the option 4.

Effect on Driving Torque

Vane cam 27 is pressed on front body 42 in the discharge region, wherein the pressing force is in a direction away from the rotating rotor 6. Accordingly, when the eccentric distance of vane cam 27 changes, the friction between vane 7 and the inner peripheral surface 80 of cam ring 8 may be increased. Although the vanes 7 in the suction region are pressed on the inner peripheral surface 80 of cam ring 8 by vane cam 27, this condition has only a small effect of increasing the driving torque.

Option 3

<Pressure on Periphery of Vane Cam>

Since the entire part of cam port 48 is supplied with the intermediate pressure, the entire outer periphery of vane cam 27 is subject to the intermediate pressure.

Force on Vane Cam in Radial Direction

The condition that the entire outer periphery of vane cam 27 is applied with the intermediate pressure, results in that the entire vane cam 27 is subject to no direct force in radial directions. However, when in the discharge region, the distal end portion of vane 7 is subject to the discharge pressure and the proximal end portion of vane 7 in contact with the vane cam 27 is subject to the intermediate pressure, so that the vane 7 is applied with a first resulting force inward in the radial direction, and the resulting force is received by the outer periphery of vane cam 27. On the other hand, when in the suction region, the distal end portion of vane 7 is subject to the suction pressure and the proximal end portion of vane 7 in contact with the vane cam 27 is subject to the intermediate pressure, so that the vane 7 is applied with a second resulting force outward in the radial direction. These radial forces are received by vanes 7 in the suction region so that vanes 7 in the suction region are pressed on the inner peripheral surface 80 of cam ring 8 to cause a frictional force. The second resulting force applied to vanes 7 in the suction process is the same as in the option 2.

Force on Vane Cam in Axial Direction

Vane cam 27 seals the slots 61 and back pressure chambers br of rotor 6, so that vane cam 27 is subject to hydraulic pressure in the axial direction of vane cam 27 or rotor 6. Accordingly, vane cam 27 is pressed on front body 42 in the discharge region, whereas vane cam 27 is pressed on rotor 6 in the suction region.

Effect on Driving Torque

Vane cam 27 is constantly pressed on and is sliding with respect to the rotating rotor 6 and the stationary front body 42. This is a factor of increasing the driving torque.

Option 4

<Pressure on Periphery of Vane Cam>

Since the entire part of cam port 48 is supplied with the discharge pressure, the entire outer periphery of vane cam 27 is subject to the discharge pressure.

Force on Vane Cam in Radial Direction

The condition that the entire outer periphery of vane cam 27 is applied with the discharge pressure, results in that the entire vane cam 27 is subject to no direct force in radial directions. However, when in the suction region, the distal end portion of vane 7 is subject to the suction pressure and the proximal end portion of vane 7 in contact with the vane cam 27 is subject to the discharge pressure, so that the vane 7 is applied with a resulting force outward in the radial direction. This outward force acts on vane 7 and presses vane 7 on the inner peripheral surface 80 of cam ring 8, causing a frictional force. This pressing force is equal to those in the options 2 and 3. On the other hand, vane cam 27 is subject to no radial force, because the outward force applied to vane 7 is in the direction away from vane cam 27.

Force on Vane Cam in Axial Direction

Vane cam 27 seals the slots 61 and back pressure chambers br of rotor 6, so that vane cam 27 is subject to hydraulic pressure in the axial direction of vane cam 27 or rotor 6. Accordingly, in the suction region, vane cam 27 is pressed onto the rotor 6.

Effect on Driving Torque

Vane cam 27 is constantly pressed on and is sliding with respect to the rotating rotor 6. This is a factor of increasing the driving torque.

After comparison among the foregoing four options, the first embodiment is provided with the option 2 that cam port 48 is supplied with the suction pressure, because the option 2 has the feature that the forces applied to vane cam 27 and vanes 7 are relatively small and the adverse effect on the driving torque by friction is relatively small.

The following summarizes the features of the first embodiment and advantageous effects produced by the features.

<1> A vane pump (1) comprises: a pump body (4); a rotor (6) housed in the pump body (4), and configured to rotate about an axis of rotation (O), wherein the rotor (6) includes an outer periphery formed with a plurality of slots (61); a cam ring (8) housed in the pump body (4), and arranged to surround the outer periphery of the rotor (6), and configured to move with eccentricity with respect to the axis of rotation (O) of the rotor (6); and a plurality of vanes (7) mounted in corresponding ones of the slots (61) of the rotor (6), and configured to project from the corresponding slots (61), and separate an annular space between the rotor (6) and the cam ring (8) into a plurality of pumping chambers (r); wherein the pump body (4) includes a first inner surface (z-axis positive direction side surface 410 of pressure plate 41) facing an axial end surface of the cam ring (8) and a first axial end surface of the rotor (6), and defining axial ends of the pumping chambers (r); the first inner surface (410) of the pump body (4) includes a suction port (43*a*), a suction-side back pressure port (46*a*), a discharge port (44*a*), and a discharge-side back pressure port (46*b*); the suction port (43*a*) is located in a suction region in which each of the pumping chambers (r) expands along with the rotation of the rotor (6); the discharge port (44*a*) is located in a discharge region in which each of the pumping chambers (r) contracts along with the rotation of the rotor (6); the suction-side back pressure port (46*a*) is located to hydraulically communicate with a proximal end portion (back pressure chamber br) of a first one of the slots (61) under condition that the vane (7) corresponding to the first slot (61) is in the suction region; the discharge-side back pressure port (46*b*) is located to hydraulically communicate with a proximal end portion (back pressure chamber br) of a second one of the slots (61) under condition that the vane (7) corresponding to the second slot (61) is in the discharge region; the suction port (43*a*) and the suction-side back pressure port (46*a*) are commonly subject to a suction pressure; the discharge port (44*a*) and the discharge-side back pressure port (46*b*) are commonly subject to a discharge pressure; the rotor (6) includes a second axial end surface opposite to the first axial end surface, wherein the second axial end surface includes a recess (circular recess 62); the vane pump (1) further comprises: a vane cam (27) mounted in the recess (62) of the rotor (6), and configured to move with eccentricity with respect to the axis of rotation (O) of the rotor (6); and a cam port (48) formed in a surface of the pump body (4) facing the vane cam (27), and configured to hydraulically communicate with the recess (62) of the rotor (6); the vane cam (27) includes an outer peripheral surface configured to contact a proximal end of each of the vanes (7), and configured to cause the projection of the vanes (7) along with the rotation of the rotor (6); and the vane cam (27) hydraulically separates the proximal end portion (br) of the first slot (61) from the proximal end portion (br) of the second slot (61). This feature serves to press vanes 7 outwardly in radial directions, and maintain suitable contact between vanes 7 and cam ring 8, and thereby suppress noise due to collision between cam ring 8 and vanes 7, even in situations where the engine and the pump are rotating at low speed, for example, when the engine is at start or at idle so that the centrifugal force acting on the vanes 7 is small and the vanes 7 tend to project insufficiently toward the inner peripheral surface 80 of cam ring 8.

<2> The vane pump is configured so that the cam port (48) is subject to the suction pressure. This feature serves to make small the forces applied to vane cam 27 and vanes 7, and thereby reduce the adverse effect of friction on the driving torque.

<3> The vane pump is configured so that: the vane cam (27) includes a through hole (27*a*) extending axially of the vane cam (27), wherein the through hole (27*a*) allows a drive shaft (5) to pass through, wherein the rotor (6) is rotated by the drive shaft (5); the pump body (4) rotatably supports the drive shaft (5) on both axial sides of the rotor (6); and the through hole (27*a*) of the vane cam (27) has an inner peripheral surface, wherein the inner peripheral surface is out of contact with the drive shaft (5) under condition that the vane cam (27)

is maximally eccentric with respect to the axis of rotation (O) of the rotor (6). This feature serves to allow drive shaft 5 to be supported at both ends and thereby support drive shaft 5 in a stable manner.

<4> The vane pump is configured so that the inner peripheral surface of the through hole (27*a*) of the vane cam (27) is configured in a manner that the vane cam (27) seals the proximal end portions of the slots (61) under condition that the vane cam (27) is maximally eccentric with respect to the axis of rotation (O) of the rotor (6). This feature serves to suitably seal the distal end portion of back pressure chamber br even when vane cam 27 is most eccentric with respect to rotor 6.

The first embodiment may be modified as follows, for example. Although vane cam 27 is mounted between front body 42 and rotor 6 in the first embodiment, vane cam 27 may be mounted between pressure plate 41 and rotor 6. In this alternative structure, suction-side back pressure port 46*a* and discharge-side back pressure port 46*b* are formed in front body 42.

Although vane cam 27 includes through hole 27*a* in the first embodiment, vane cam 27 may be formed like a disc without through hole 27*a*. In this alternative structure, vane cam 27 is mounted between rotor 6 and pressure plate 41. Since vane cam 27 includes no through hole 27*a*, drive shaft 5 is rotatably supported only by front body 42.

The entire contents of Japanese Patent Application 2012-064765 filed Mar. 22, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A vane pump comprising:

a pump body;

a rotor housed in the pump body, and configured to rotate about an axis of rotation, wherein the rotor includes an outer periphery formed with a plurality of slots;

a cam ring housed in the pump body, and arranged to surround the outer periphery of the rotor, and configured to move with eccentricity with respect to the axis of rotation of the rotor; and a plurality of vanes mounted in corresponding ones of the slots of the rotor, and configured to project from the corresponding slots, and separate an annular space between the rotor and the cam ring into a plurality of pumping chambers, wherein:

the pump body includes a first inner surface facing an axial end surface of the cam ring and a first axial end surface of the rotor, and defining at least an axial end of the pumping chambers;

the first inner surface of the pump body includes a suction port, a suction-side back pressure port, a discharge port, and a discharge-side back pressure port;

the suction port is located in a suction region in which each of the pumping chambers expands along with the rotation of the rotor;

the discharge port is located in a discharge region in which each of the pumping chambers contracts along with the rotation of the rotor;

the suction-side back pressure port is located to hydraulically communicate with a proximal end portion of a first slot of the plurality of slots, the vane corresponding to the first slot being in the suction region;

the discharge-side back pressure port is located to hydraulically communicate with a proximal end portion of a second slot of the plurality of slots, the vane corresponding to the second slot being in the discharge region;

the suction port and the suction-side back pressure port are subject to a suction pressure;

the discharge port and the discharge-side back pressure port are subject to a discharge pressure;

the rotor includes a second axial end surface opposite to the first axial end surface, wherein the second axial end surface includes a recess;

the vane pump further comprises:

a vane cam mounted in the recess of the rotor, and configured to move with eccentricity with respect to the axis of rotation of the rotor; and a cam port formed in a surface of the pump body facing the vane cam, and configured to hydraulically communicate with the recess of the rotor;

the vane cam includes an outer peripheral surface configured to contact a proximal end of each of the vanes, and configured to cause projection of the vanes along with the rotation of the rotor;

the vane cam constantly hydraulically separates the proximal end portion of the first slot from the proximal end portion of the second slot, and the vane cam seals the proximal end portion of the first slot from the proximal end portion of the second slot.

2. The vane pump as claimed in claim 1, wherein the cam port is subject to the suction pressure.

3. The vane pump as claimed in claim 1, wherein:

the vane cam includes a portion defining a through hole extending axially of the vane cam, wherein the through hole allows a drive shaft to pass through, wherein the rotor is rotated by the drive shaft;

the pump body rotatably supports the drive shaft on both axial sides of the rotor; and the portion of the vane cam has an inner peripheral surface, wherein the inner peripheral surface is out of engaging contact with the drive shaft under a condition in which the vane cam is maximally eccentric with respect to the axis of rotation of the rotor.

4. The vane pump as claimed in claim 3, wherein the inner peripheral surface of the portion of the vane cam is configured in a manner that the vane cam seals the proximal end portions of the slots under the condition that the vane cam is maximally eccentric with respect to the axis of rotation of the rotor.

5. The vane pump as claimed in claim 4, wherein the pump body includes a front body and a rear body, wherein the recess of the rotor in which the vane cam is mounted faces the front body.

6. The vane pump as claimed in claim 5, wherein the vane cam, including the portion defining the through hole, is disc-shaped.

7. The vane pump as claimed in claim 1, wherein an outer diameter of the vane cam is smaller by twice a length of each vane than a diameter of an inner peripheral surface of the cam ring.

* * * * *